US006002781A

United States Patent [19]

Takayama et al.

[11] Patent Number: 6,002,781

[45] Date of Patent: Dec. 14, 1999

[54] SPEAKER SYSTEM

[75] Inventors: Satoshi Takayama, Osaka; Kazuki Honda, Matsusaka, both of Japan

[73] Assignee: Matsushita Electric Industrial Co., Ltd., Osaka, Japan

[21] Appl. No.: 08/504,145

[22] Filed: Jul. 19, 1995

Related U.S. Application Data

[63] Continuation of application No. 08/201,003, Feb. 24, 1994, abandoned.

[30] Foreign Application Priority Data

Feb. 24, 1993 [JP] Japan ..... 5-035037

[51] Int. Cl.[6] ..... H04R 25/00

[52] U.S. Cl. ..... 381/338; 381/345; 381/351

[58] Field of Search ..... 381/337, 338, 381/345, 349, 351, FOR 140, FOR 141, FOR 146, 353, 348; 181/156, 185, 186, 187, 189, 196, 197, 199

[56] References Cited

U.S. PATENT DOCUMENTS

| | | | |
|---|---|---|---|
| 2,739,659 | 3/1956 | Daniels | 381/153 |
| 3,978,941 | 9/1976 | Siebert . | |
| 4,742,887 | 5/1988 | Yamagishi | 381/154 |
| 5,012,890 | 5/1991 | Nagi et al. . | |
| 5,197,103 | 3/1993 | Hayakawa | 381/159 |

FOREIGN PATENT DOCUMENTS

| | | | |
|---|---|---|---|
| 0336303 | 10/1989 | European Pat. Off. | 381/159 |
| 1068099 | 3/1989 | Japan . | |
| 1-254097 | 10/1989 | Japan . | |
| 0090893 | 3/1990 | Japan . | |
| 4170298 | 6/1992 | Japan . | |

*Primary Examiner*—Huyen Le
*Attorney, Agent, or Firm*—Ratner & Prestia

[57] ABSTRACT

A speaker system comprises an acoustic tube with one end coupled to the back side of the speaker unit and the other end released to a sound field space through an opening window, and at least one air chamber disposed along the acoustic tube. The cross sectional area of the air chamber is larger than the cross sectional area of the acoustic tube, and the cross sectional area of the opening window is smaller than the cross sectional area of the acoustic tube. Therefore, the air chamber forms an acoustic filter so that the higher resonance frequency components in medium and high frequency region caused in the acoustic tube may not be radiated from the opening window, and formation of peaks and bottoms of frequency characteristic due to interference with the sound radiated from the front side of the speaker is prevented. The opening window of a small cross sectional area lowers the resonance frequency of the acoustic tube. Alternatively, the speaker system comprises an acoustic tube with one end coupled to the back side of the speaker unit and the other end released to a sound field space through an opening window, and at least one air chamber disposed along the acoustic tube. The cross sectional area of the air chamber is larger than the cross sectional area of the acoustic tube, and the cross sectional area of the opening window is smaller than the cross sectional area of the acoustic tube. The branch chamber possessing different route lengths causes a phase difference in the acoustic tube to cancel the resonance in the acoustic tube, so that formation of peaks and bottoms in the frequency characteristic may be prevented. An acoustic tube with one end closed and other end coupled to the front side of the speaker, suppresses the amplitude of the diagram of the speaker under low frequency region and the generation of abnormal sound such as speaker bottom beat phenomenon.

12 Claims, 3 Drawing Sheets

SPEAKER SYSTEM

This application is a continuation of application Ser. No. 08/201,003 filed Feb. 24, 1994, abandoned.

BACKGROUND OF THE INVENTION

1. Field of the Invention

The present invention relates to a speaker system with enhanced efficiency and frequency characteristics. More particularly, the invention relates to a speaker system with an expanded bass register which is accomplished by coupling an acoustic tube to the back side of a speaker unit.

2. Description of the Related Art

A speaker system with an expanded bass register which is accomplished by coupling an acoustic tube to the back side of a speaker unit is known.

The conventional speaker system is described below with reference to FIG. 5. FIG. 5 is a sectional view showing the constitution of a conventional speaker system. In the diagram, numeral 1 denotes a cabinet, 2*a*, 2*b*, 2*c*, 2*d* and 2*e* are partitions for forming an acoustic tube by partitioning the inside of the cabinet 1, 3 is an opening window disposed in the lower part of a front panel of the cabinet 1, and 4 is a speaker unit disposed above the front panel.

The partitions 2*a*, 2*b*, 2*c*, 2*d* and 2*e* disposed in the cabinet 1 form an acoustic tube in the cabinet 1, and the sound delivered from the back side of the speaker unit 4 is radiated from the opening window 3 through the acoustic tube.

The acoustic tube resonates at a specific frequency fn, and assuming the overall length of the acoustic tube to be L and the sound velocity in the air to be C, the resonance frequency fn is expressed as $$fn=(C/4L)\times(2n+1)$$

where n is 0, 1, 2, or another integer.

In the case of n=0, that is, at the frequency resonating with ¼ wavelength in the acoustic tube, the acoustically magnified sound is radiated from the opening window 3 of the acoustic tube, and the efficiency is notably enhanced near the frequency at the reproduction limit of the bass.

At n=1, that is, at the frequency resonating with a ½ wavelength in the acoustic tube, the sound is radiated from the front side of the speaker unit 4, while the sound from the back side is inverted in phase by a delay of a half wavelength in the acoustic tube, and is radiated from the opening window 3. Sound from the front side and the back side are added in the front space of the cabinet 1, so that the sound pressure level increases at that frequency.

At n=2, that is, at the frequency resonating with a ¾ wavelength in the acoustic tube, as in the case of n=0, the acoustically magnified sound is radiated from the opening window 3.

Thus, in the bass region, a speaker system of high efficiency has been realized.

In such conventional speaker systems, however, even at frequencies in the medium and high frequency region corresponding to n=3 or higher, resonance occurs in the acoustic tube, and the sound is radiated from the opening window 3. The sound from the opening window 3 interferes with the front sound of the speaker unit 4. Peaks and bottoms of sound pressure occur in the medium and high frequency region as indicated by the broken line in the reproduced sound pressure frequency characteristic diagram in FIG. 2. The characteristics of the medium and high pressure region are highly deteriorated resulting in lowered sound quality. In addition, the frequency of the bass reproduction limit is defined by the overall length L of the acoustic tube, and therefore to reproduce the lower frequency region, the overall length L of the acoustic tube is desirably extended, which causes to increase the size of the speaker system.

SUMMARY OF THE INVENTION

A speaker system in accordance with an exemplary embodiment of the present invention comprises a speaker unit having the front side coupled to an open space, and an acoustic tube with one end coupled to the back side of the speaker unit and the other end extending to a sound field space through an opening window. At least one air chamber is disposed along the acoustic tube, the cross sectional area of the air chamber is set larger than the cross sectional area of the acoustic tube, and the cross sectional area of the opening window is set smaller than the cross sectional area of the acoustic tube.

The speaker system in accordance with a further exemplary embodiment of the present invention comprises a speaker unit having the front side coupled to an enclosed space, and an acoustic tube with one end coupled to the back side of the speaker unit and the other end extending to a sound field space through an opening window. At least one air chamber is disposed along the acoustic tube, the cross sectional area of the air chamber is set larger than the cross sectional area of the acoustic tube, and the cross sectional area of the opening window is set smaller than the cross sectional area of the acoustic tube.

Alternatively, the speaker system comprises a speaker unit having the front side coupled to an open space, and an acoustic tube with one end coupled to the back side of the speaker unit and the other end extending to a sound field space through an opening window. At least one air chamber and a bypass chamber are disposed along the acoustic tube, the cross sectional area of the air chamber is set larger than the cross sectional area of the acoustic tube, the cross sectional area of the opening window is set smaller than the cross sectional area of the acoustic tube, and the bypass chamber possesses plural bypass routes differing in the route length individually.

Moreover, the speaker system comprises a speaker unit having the front side coupled to an enclosed space, and an acoustic tube with one end coupled to the back side of the speaker unit and the other end extending to a sound field space through an opening window, wherein at least one air chamber and a bypass chamber are disposed along the acoustic tube, the cross sectional area of the air chamber is set larger than the cross sectional area of the acoustic tube, the cross sectional area of the opening window is set smaller than the cross sectional area of the acoustic tube, and the bypass chamber possesses plural bypass routes differing in the route length individually.

In these exemplary embodiments, the speaker system operates as follows. The air chamber provided along the acoustic tube acts as an acoustic filter by the reactance component presented by the acoustic compliance of the acoustic tube, and the sound of the medium and high frequency region from the back side of the speaker unit is acoustically cut off, and not released from the opening window.

When the cut-off frequency fn of the acoustic filter is set at the resonance frequency of ¾ wavelength in the acoustic tube, that is, $$fn=3C/(4L),$$

at a frequency lower than about a frequency where the ¾ wavelength is nearly equal to the length L of the acoustic tube, the impedance presented by the air chamber is small because of reactance component, and therefore no action occurs as an acoustic filter, and the air chamber has no effect on the reproduced sound pressure frequency characteristic. In bands higher than this frequency, however, the effect as the acoustic filter is exhibited, and interference of the sound radiated from the opening window and the sound radiated from the front side of the speaker is lowered, thereby preventing formation of peaks and bottoms in the frequency characteristic.

Furthermore, the opening window of the smaller cross sectional area than the sectional area of the acoustic tube works as the acoustic mass, and the resonance frequency of the acoustic tube is lowered, and the reproduction band is widened to a lower resonance frequency determined by the overall length L of the acoustic tube, so that a speaker system of excellent frequency characteristic may be presented.

In addition, the bypass chamber possessing plural routes with different route lengths generates a phase difference in the acoustic tube, and cancels resonance and prevents occurrence of peaks and bottoms.

DESCRIPTION OF THE PREFERRED EMBODIMENTS

Figure 1:
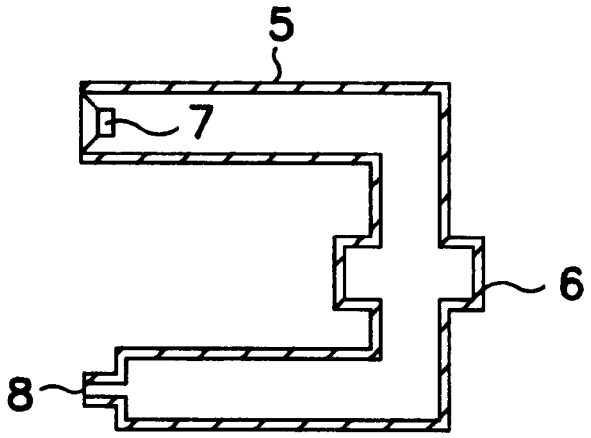
FIG. 1 is a sectional view showing a speaker system in accordance with a first exemplary embodiment of the present invention.

FIG. 1 is a sectional view of the first exemplary embodiment of the present invention. In the drawing, numeral 5 denotes an acoustic tube, 6 is an air chamber functioning as an acoustic filter, being formed along the acoustic tube 5 so as to have a wider sectional area than the sectional area of the acoustic tube 5, 7 is a speaker unit coupled to the acoustic tube 5, and 8 is an opening window functioning as an acoustic mass, possessing a smaller cross sectional area than the cross sectional area of the acoustic tube 5. An acoustic tube 5 is coupled to the back side of the speaker unit 7, with the air chamber 6 functioning as an acoustic filter along the acoustic tube 5, and the opening window 8 functioning as an acoustic mass.

The exemplary speaker system operates as follows. The compliance of the air chamber 6 works as a capacitance component, and when the frequency of the sound passing through the air chamber 6 becomes higher, the impedance of the air chamber 6 becomes smaller, and attenuated components are radiated from the opening window 8.

Figure 2:
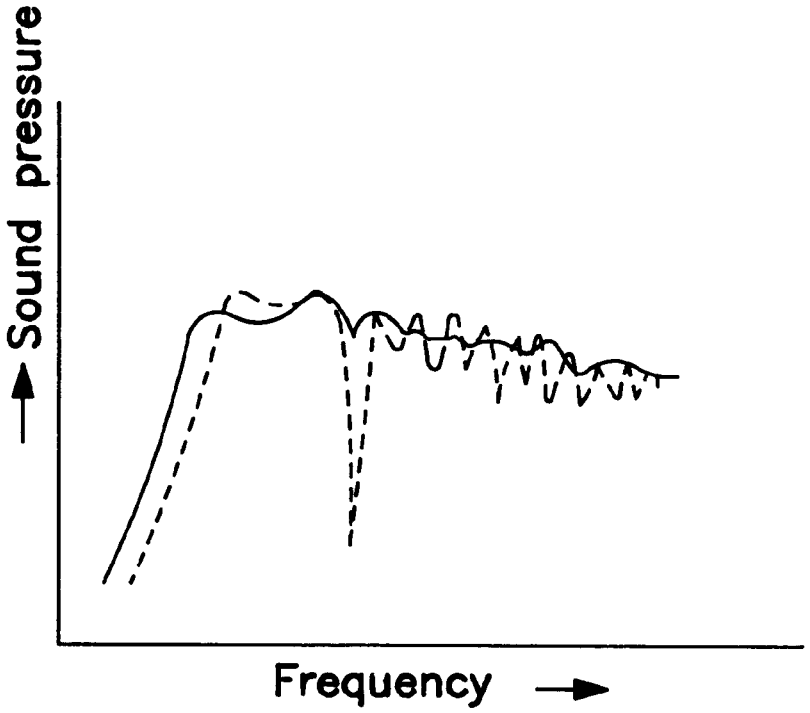
FIG. 2 is a graph showing the reproduction sound pressure frequency characteristics of the speaker system in accordance with the first exemplary embodiment of the present invention, and a conventional speaker system.

In the low frequency region, on the other hand, the impedance presented by the air chamber 6 is large, and the acoustic tube 5 functions as in the prior art, and the low frequency component is directly radiated from the opening window 8. Therefore, by setting the cross sectional area of the air chamber 6 for making cut-off frequency of the air chamber 6 nearly equal to ¾ of resonance frequency of the acoustic tube 5, the air chamber 6 has no effect on the frequency component less than about the frequency expressed by fn=3C/4L (n=2) intended to enhance the efficiency in the low frequency by making use of the resonance of the acoustic tube 5, and applies attenuation by filter effect for higher frequency components. Thus, the sound radiated from the opening window 8 has a smaller interference with the sound radiated from the front side of the speaker unit 7 in the medium and high frequency region. This results in nearly flat reproduction sound pressure frequency characteristics in the register from the low frequency region to the medium and high frequency region. Moreover, since the opening window 8 has a smaller cross sectional area than the cross sectional area of the acoustic tube functions as the acoustic mass, the resonance frequency of the acoustic tube 5 can be set lower than the resonance frequency determined by the overall length (L). An example of the characteristics of this exemplary embodiment is indicated by the solid line in FIG. 2. In FIG. 2 point A is defined by equation:

$$\lambda=(4/3)*L$$

where λ is the wave length and L is the total length of the acoustic pipe.

Thus, according to the speaker system in accordance with the exemplary embodiment of the present invention, an acoustic filter is formed by disposing an air chamber along the acoustic tube, and the cross sectional area of the air chamber is larger than the cross sectional area of the acoustic tube so that its cut-off frequency may be nearly equal to the ¾ resonance frequency of the acoustic tube, and therefore the interference of the front side sound of the speaker unit and the sound from the opening window in the medium and high frequency is decreased to obtain a smooth frequency characteristics without peaks and bottoms. By having the cross sectional area of the opening window smaller than the cross sectional area of the acoustic tube, the bass register can be lowered below the frequency determined by the length of the acoustic tube, so that a speaker system of excellent characteristics can be realized.

In the exemplary embodiment, meanwhile, the sectional shape of the air chamber 6 is square. However, other shapes as long as the cross sectional area is larger than that of the acoustic tube, and similar effects can be obtained regardless of the shape. Moreover, by disposing a plurality of air chambers, various characteristics of the acoustic filter may be obtained.

(Embodiment 2)

Figure 3:
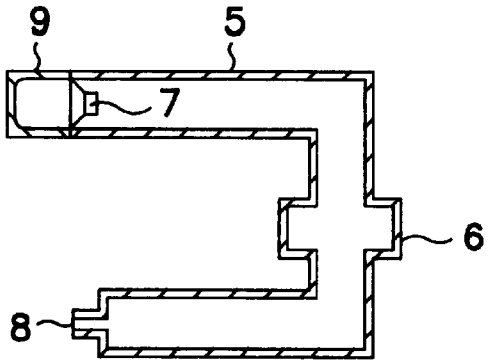
FIG. 3 is a sectional view showing the constitution of a speaker system in accordance with a second exemplary embodiment of the present invention.

The second exemplary embodiment of the invention is described herein by reference to FIG. 3. FIG. 3 is a sectional view showing the exemplary embodiment. Elements which are similar to those in embodiment 1 are identified with identical reference numerals, and their explanations are omitted. In the drawing, numeral 9 is a cabinet disposed at the front side of the speaker unit in order to form a space of an enclosed structure.

Explaining the operation of this exemplary embodiment, the acoustic tube 5 disposed at the back side of the speaker unit 7 improves the reproduction capacity in the low frequency region similarly as in embodiment 1, and also smooths the reproduction sound pressure frequency characteristics in the medium and high frequency region. In this embodiment, furthermore, the cabinet 9 of the enclosed structure is disposed at the front side of the speaker unit 7, and by enclosing the air at the front side of the speaker, the amplitude of the diaphragm of the speaker under the low frequency region reproduction limit is effectively suppressed, the diaphragm does not vibrate abnormally if an excessive input is applied to the speaker unit, and the generation of abnormal sounds (such as speaker bottom beat phenomenon) is prevented. Thus, a speaker system of high reliability and high input resistance is obtained.

The air chamber in this exemplary embodiment disposed along the acoustic tube does not prevent interference with the direct sound from the front side of the speaker unit, but prevents interference with the direct sound due to vibration of the cabinet itself even when enclosed, thereby offering similar effects as in embodiment 1.

In FIG. 3, meanwhile, the acoustic tube 5 is folded over only once, although more than one folding may be included.

(Embodiment 3)

Figure 4:
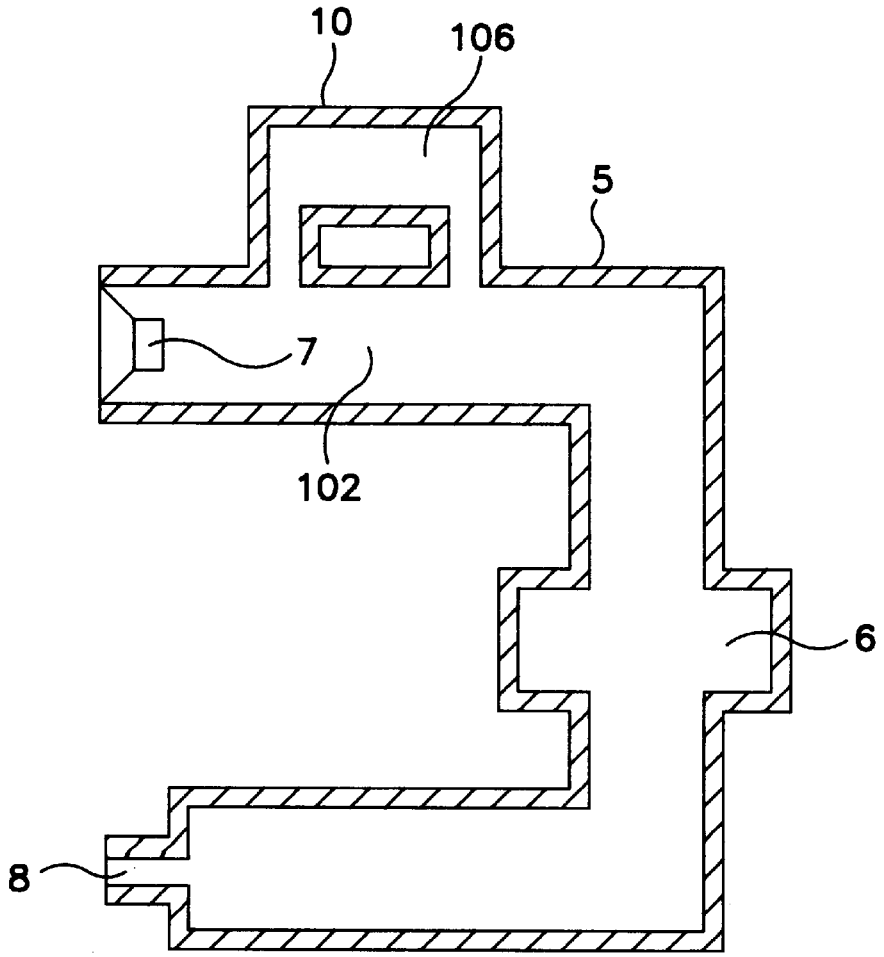
FIG. 4 is a sectional view showing the constitution of a speaker system in accordance with a third exemplary embodiment of the present invention.
Figure 5:
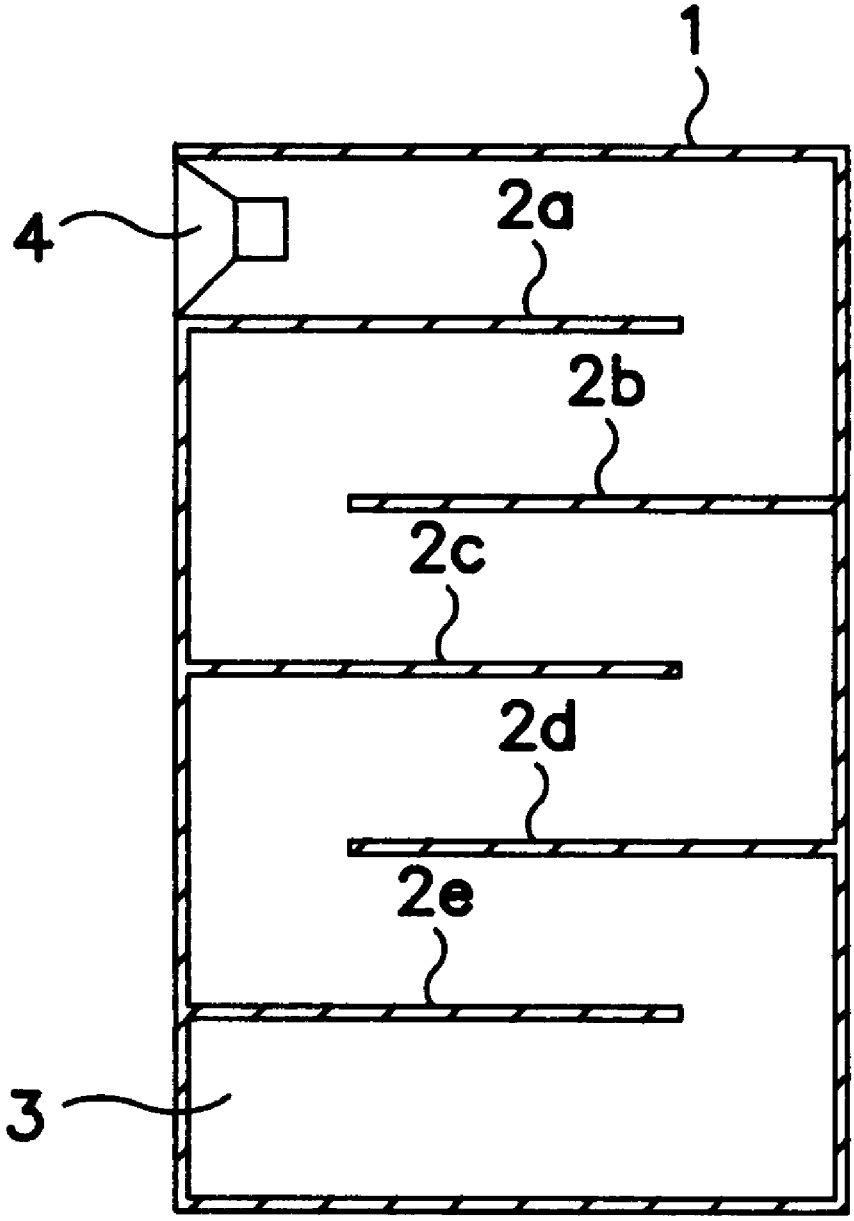
FIG. 5 PRIOR ART
FIG. 5 is a sectional view showing the constitution of a conventional speaker system.

The third exemplary embodiment of the present invention is described below by reference to FIG. 4. FIG. 4 is a sectional view of the third embodiment. In the drawing, numeral 10 is a bypass chamber disposed on the way of the route of the acoustic tube 5, and a part of the acoustic tube 5 is branched into a plurality of routes 10*a*, 10*b* differing in length. The other constituent elements which are similar in the first embodiment are identified with identical reference numerals, and detailed descriptions are omitted.

The speaker system of this exemplary embodiment functions as follows. The acoustic tube 5 coupled to the back side of the speaker unit 7, and the extending air chamber 6 present an excellent speaker system which is excellent in low frequency region reproduction, and smooth in reproduction sound region characteristic in the medium and high frequency region, as in the first embodiment. A bypass chamber 10 disposed on the way of the route of the acoustic tube 5 can cancel sharp peaks and bottoms due to resonance of the acoustic tube 5 by generating phase difference by routes 10*a*, 10*b* differing in length, so that an excellent speaker system widened in the reproduction frequency band can be presented. In addition, by selecting the difference in length of the routes 10*a*, 10*b* of the bypass chamber 10, the frequency desired to be canceled can be selected, and it can be set freely as required. In this exemplary embodiment, the bypass chamber 10 is divided into two routes 10*a*, 10*b*, but the same effects are obtained by dividing into a plurality of more than two depending on the desired reproduction sound pressure frequency characteristics.

Thus, according to the speaker system of this exemplary embodiment, by disposing the air chamber on the way of the acoustic tube to compose the acoustic filter, formation of peaks and bottoms due to resonance frequency of higher degree can be prevented, and by disposing bypass chambers differing in the route length on the way of the acoustic tube, the resonance in the acoustic tube is canceled by generating phase difference, and formation of peaks and bottoms of frequency characteristics is prevented, so that a smooth frequency characteristics can be realized.

What is claimed:

1. A speaker system comprising:

a speaker unit having a front side and a back side, an acoustic tube with one end coupled to the speaker unit and the other end having an opening window, said acoustic tube having a cross sectional area and said opening window having a cross section area, the back side of the speaker extending into the acoustic tube, and at least one air chamber which is a low pass filter situated directly between the end of the acoustic tube coupled to the speaker unit and the end having an opening window so that air flows between the one end and the other end of the acoustic tube via the air chamber, wherein the air chamber has a cross sectional area which is larger than the cross sectional area of the acoustic tube, and the cross sectional area of the opening window is smaller than the cross sectional area of the acoustic tube.

2. A speaker system according to claim 1, wherein a listener hears sound coming from both said speaker unit and said opening window.

3. A speaker system comprising:

a speaker unit having a front side and a back side, the front side of the speaker coupled to an enclosed space, an acoustic tube with one end coupled to the speaker unit and the other end having an opening window, said acoustic tube having a cross sectional area and the opening window having a cross sectional area, the back side of the speaker extending into the acoustic tube, and at least one air chamber directly situated between the end of the acoustic tube coupled to the speaker unit and the end having an opening window so that air flows between the one end and the other end of the acoustic tube via the air chamber, wherein the air chamber has a cross sectional area which is larger than the cross sectional area of the acoustic tube, and the cross sectional area of the opening window is smaller than the cross sectional area of the acoustic tube.

4. A speaker system according to claim 3, wherein said air chamber is a low pass filter.

5. A speaker system according to claim 3, wherein a listener hears sound coming from both said speaker unit and said opening window.

6. A speaker system comprising:

a speaker unit having a front side and a back side, an acoustic tube with one end having an opening window, the back side of the speaker extending into the acoustic tube, said acoustic tube having a cross sectional area and the opening window having a cross sectional area, and at least one air chamber which is a low pass filter and a bypass chamber situated between the end of the acoustic tube having the opening window and the back side of said speaker extending into said acoustic tube so that air flows between the one end and the other end of the acoustic tube via the air chamber, wherein the air chamber has a cross sectional area which is larger than the cross sectional area of the acoustic tube, the cross sectional area of the opening window is smaller than the cross sectional area of the acoustic tube, and the bypass chamber includes a bypass route extending from one location on the acoustic tube to another location on the acoustic tube.

7. The speaker system of claim 6 further including a further bypass route, said bypass route and said further bypass route having different lengths.

8. A speaker system according to claim 6, wherein a listener hears sound coming from both said speaker unit and said opening window.

9. A speaker system comprising:

a speaker unit having a front side and a back side, the front side of the speaker coupled to an enclosed space, an acoustic tube with one end having an opening window, the back side of the speaker extending into the acoustic tube, said acoustic tube having a cross sectional area and said opening window having a cross sectional area, and at least one air chamber and a bypass chamber are disposed between the end of the acoustic tube having an opening window and the back side of said speaker extending into said acoustic tube so that air flows between the one end and the other end of the acoustic tube via the air chamber, said at least one air chamber having a cross sectional area which is larger than the cross sectional area of the acoustic tube, the cross sectional area of the opening window is smaller than the cross sectional area of the acoustic tube, and the bypass chamber includes a bypass route extending from one location on the acoustic tube to another location on the acoustic tube.

10. The speaker system of claim 9 further including a further bypass route, said bypass route and said further bypass route having different lengths.

11. A speaker system according to claim 9, wherein said air chamber is a low pass filer.

12. A speaker system according to claim 9, wherein a listener hears sound coming from both said speaker unit and said opening window.

* * * * *